United States Patent [19]

Ray, Sr.

[11] Patent Number: 4,942,663

[45] Date of Patent: Jul. 24, 1990

[54] SHEATH

[76] Inventor: Edward D. Ray, Sr., 1428 N. Bellview, Mesa, Ariz. 85203

[21] Appl. No.: 341,768

[22] Filed: Apr. 21, 1989

[51] Int. Cl.[5] ..... B26B 3/06; B26B 3/00; B26B 29/02; A45F 5/00

[52] U.S. Cl. ..... 30/151; 30/162; 224/183; 224/232

[58] Field of Search ..... 30/151, 162, 143, 142; 224/183, 232, 193, 195, 252, 253, 236

[56] References Cited

U.S. PATENT DOCUMENTS

| | | | |
|---|---|---|---|
| 3,044,673 | 7/1962 | Manning | 224/232 |
| 3,257,050 | 6/1966 | Smith | 224/232 |
| 3,363,813 | 1/1968 | Eastman | 224/232 |
| 3,533,540 | 10/1970 | Carinci | 224/232 |
| 3,741,376 | 6/1973 | Brown | 224/183 |
| 4,263,714 | 4/1981 | Todd, Sr. | 30/151 |
| 4,326,652 | 4/1982 | Fortenberry | 224/232 |
| 4,726,498 | 2/1988 | Esposito | 30/151 |

*Primary Examiner*—Douglas D. Watts
*Assistant Examiner*—Paul M. Heyrana, Sr.
*Attorney, Agent, or Firm*—Cahill, Sutton & Thomas

[57] ABSTRACT

A knife sheath having front and back panels made of flexible material is lined with elongated flexible magnets affixed to the inner surface of the panels. The magnets grip the blade of the knife holding it in the sheath. Non-magnetic material separates the ends of the magnets at the sheath opening to facilitate entry of the knife blade into the sheath. A stiffener plate extending from a belt loop to the back panel prevents the connection between the belt loop and that panel from buckling when the knife is withdrawn. The stiffener plate may extend into the space between the sheath panels a substantial distance and have a flange on the edge thereof for preventing contact between the knife point and the edge of the sheath.

8 Claims, 1 Drawing Sheet

2
26
29
12
19
19
31
32
23
4
4
19
11
14
18
16
13
17
2

28
26
29
32
31
11
23
33
24
22
22
13
14
20
19
18

34
27
28
27
24
14
18
15
17
13
17

32
33
37
22
22
36
17 19 20 14 22
15
13
16
18 22 13 37

SHEATH

TECHNICAL FIELD

This invention is concerned with sheaths or scabbards of the type employed to carry knives or other bladed implements at the waist of a user.

BACKGROUND ART

It has been customary to provide some means for locking swords, bayonets and knives within their sheaths to prevent accidental dislodgement of these implements. This is particularly true with respect to sharp blade instruments such as, for example,a hunting knife. The common retaining means for a hunting knife is a segmented strap with a snap fastener to secure the strap around the handle of the knife.

The presence of a retainer strap on a knife sheath can interfere with removal of the knife from the sheath and replacement of the knife in the sheath. This can be very disconcerting to, say, a hunter who likely is occupied with other tasks at the same time that he needs to extract the knife from or return it to its sheath.

W.A. Villwock in his U.S. Pat. No. 3,008,617, granted Nov. 14, 1961, for "ARTICLE ENCASEMENT DEVICES" discloses the idea of positioning permanent magnets in pockets of the walls of a knife sheath to hold the knife within the sheath. The principal disadvantage of the Villwock sheath is the requirement that magnet retention pockets be embossed or otherwise formed in the walls of the sheath. Further, because Villwock proposes the use of small magnets of the metallic variety he presents the dilemma of whether to use only a few magnets with the risk of insecurely retaining the knife or to use many magnets with their attendant cost.

There continues to be a need for a magnetic knife retention sheath which is easily and inexpensively constructed and which offers reliability and ease of use.

DISCLOSURE OF THE INVENTION

This invention contemplates the use of at least one and perferably two elongated, flexible magnetic strips at the inner faces of the front and back panels of the sheath. The magnetic strips are preferably nearly coextensive in length with those panels. This enables the knife blade to be magnetically grasped and frictionally engaged along a substantial portion of the length of the blade thereby insuring against accidental withdrawal of the knife.

Another feature of the invention is nonmagnetic spacer means separating the ends of the magnetic strips at the opening to the sheath pocket. This facilitates insertion of the knife between the magnetic strips.

A further feature is a stiffener plate in the connection between the back panel of the sheath and a belt loop to prevent the connection from buckling when the knife is withdrawn from the sheath.

BRIEF DESCRIPTION OF THE DRAWING

The invention is described in greater detail hereinafter by reference to the accompanying drawing wherein.

BEST MODE FOR CARRYING OUT THE INVENTION

Figures 1, 2, 3, 4:
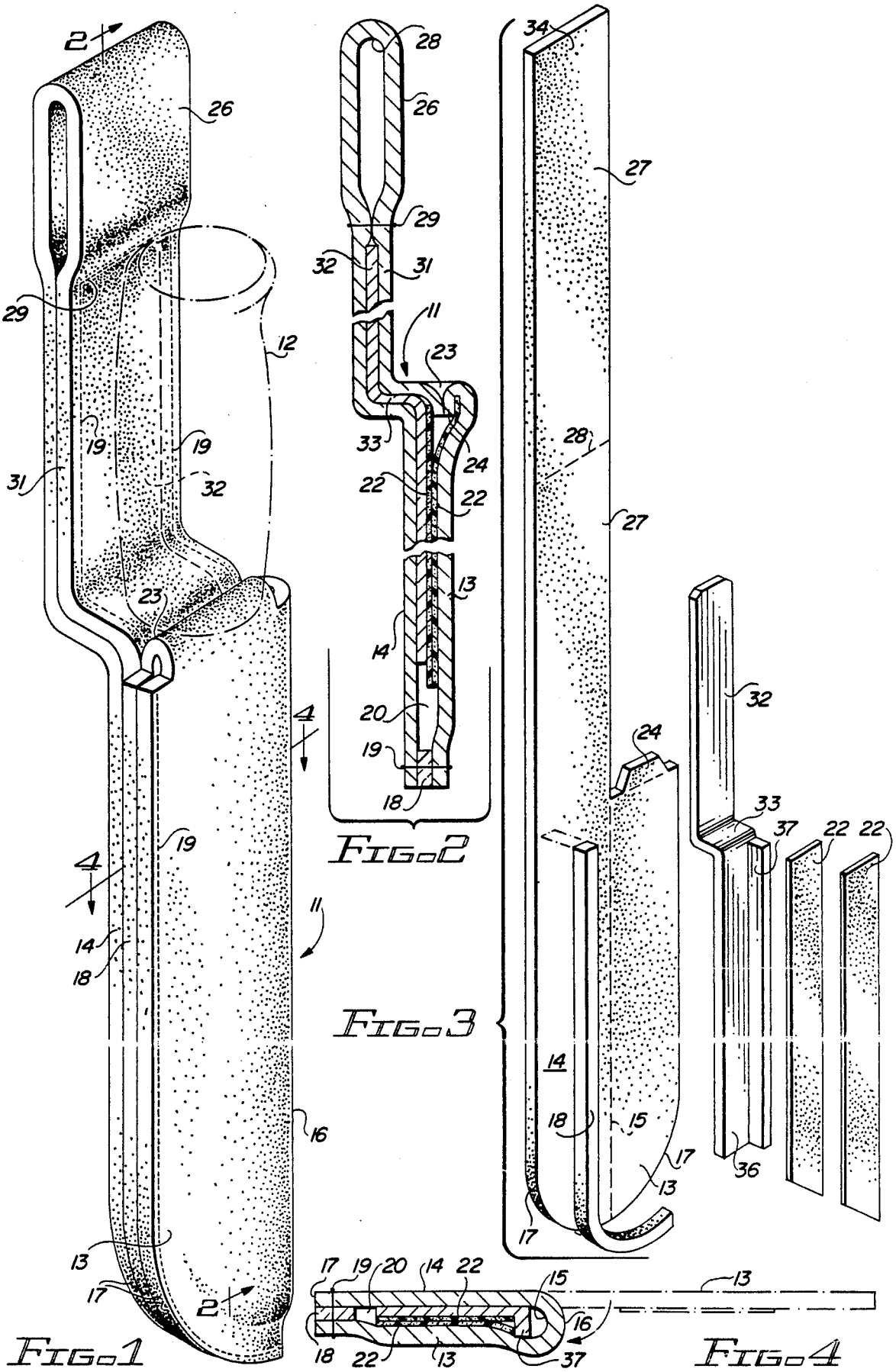
FIG. 1 is a perspective view from above of a knife sheath embodying this invention.
FIG. 2 is a foreshortened vertical sectional view through the sheath taken as indicated by line 2—2 in FIG. 1.
FIG. 3 is an exploded perspective view illustrating the manner in which the sheath is fabricated.
FIG. 4 is a horizontal sectional view taken as indicated by the line 4—4 in FIG. 1.

Referring particularly to FIG. 1, reference numeral 11 indicates generally the sheath of this invention for carrying a knife, indicated in phantom at 12.

The sheath 11 includes elongated front and back panels, 13 and 14, respectively, made from a wear resistant flexible material such as leather. Both panels 13 and 14 are preferably formed from a single sheet of material which is folded along a line 15 to provide a straight edge 16 of the sheath. Panels 13 and 14 may be cut out to provide curved opposite edges 17. Positioned between the curved edges 17 of panels 13 and 14 is a curved filler strip 18. Stitching 19 through the curved edges 17 of panels 13 and 14 and filler strip 18 complete the knife blade receiving portion of the sheath and provide an open ended pocket 20 to receive the blade.

The sheath 11 is equipped with magnetic means for retaining the knife 12 within the sheath. In accordance with this invention the magnetic means take the form of a pair of elongated flexible magnetic strips 22 which line the interior faces of and are substantially coextensive in length with the sheath panels 13 and 14. Magnetic strips 22 are positioned at the inner faces of panels 13 and 14 and positioned to contact opposite faces of a knife blade inserted in sheath pocket 20. Magnetic strips 22 may be held in place in the sheath by a suitable adhesive.

Magnetic strips 22 are preferably made of extruded vinyl plastic, or other rubber-like flexible material, impregnated with fine granular ceramic magnetic material. Such magnetic strips have a high degree of permanency and are commonly used in magnetic door gaskets such as those used on domestic refrigerator doors. Magnetic strips of this type are inexpensive compared to high performance metallic magnets.

The flexible rubber-like magnetic strips 22 are particularly effective to reliably retain a knife blade within the sheath 11. In the first place, the strips possess sufficient flexibility to engage the knife blade over a substantial area of its surface. Secondly, the coefficient of friction of the strips 22 is such as to resist sliding movement of the blade over the surface of the strips. A conscious pull on the handle of the knife is required to withdraw the knife blade from between magnetic strips 22. Consequently, accidental withdrawal of the blade is rendered highly unlikely. And it is to be kept in mind that retention of the knife in the sheath 11 is accomplished without a separate locking strap or catch which could interfere with intentional removal and/or reinsertion of the knife into the sheath.

Insertion of a knife blade into pocket 20 of the sheath is facilitated by non-magnetic spacer means separating the magnetic strips 22 at the opening 23 to the sheath pocket. This separating means preferably takes the form of a flap 24 on the top edge of front panel 13 which is simply folded down into the opening 23 and over the upper edge of the magnetic strip 22 adjacent the front panel. The flap 24 thus has a portion positioned between the ends of magnetic strips 22 at the opening 23. This breaks the magnetic attraction between the ends of the strips 22 at opening 23 so that the point of the knife blade is easily inserted between the strips. Further entry of the knife blade simply peels the magnetic strips apart so that they then magnetically grip the blade itself.

The sheath of this invention also preferably includes a belt loop 26 connected to its back panel 14. Indeed, the belt loop can be formed integrally with the panels 13 and 14 from the same sheet of material. This is done by cutting the base sheet to the configuration shown in FIG. 3 with the belt loop 26 and its connection provided by an elongated extension 27 of back panel 14. Extension 27 is folded at fold line 28 and a line of stitching 29 provided beneath the fold line forms the belt loop 26. The remainder of extension 27 forms the connection 31 between the loop 26 and panel 14.

Because the blade of knife 12 is held firmly between magnetic strips 22 in the sheath 11 the force required to withdraw the knife has a tendency to buckle the connection 31 between belt loop 26 and sheath back panel 14. To prevent this condition it may be desirable to incorporate a stiffening plate 32 within the connection 31. Stiffening plate 32 may be formed of rigid plastic or metal such as aluminum. Plate 32 preferably is formed with an offset 33 to offset connection 31 from the sheath opening 23 to provide space for the handle of the knife (see FIGS. 1 and 2).

It is also desirable that the distal end 34 of extension 27 extend down over the upper edge of the magnetic strip associated with the back panel 14. This extension end 34 assists in separating the upper edges of the magnetic strips 22 to facilitate insertion of the knife blade as explained above.

If desired, stiffening plate 32 may be provided with a lower extension 36 beneath offset 33 and extending a substantial distance into the blade pocket 20. This extension 36 carries a longitudinal edge flange 37. The flange 37 lines the forward edge of blade pocket 20 to prevent the point of the blade from damaging the sheath at the fold line 15 between front and rear panels 13 and 14 when the blade is inserted into pocket 20.

From the foregoing it should be apparent that this inventiion provides a sheath of simple and inexpensive construction which is capable of securely retaining a knife without the need for separate catches or straps or the like.

What is claimed is:

1. A knife sheath comprising elongated front and back panels made of flexible material, said panels being joined along their longitudinal edges and providing an opening at one end for insertion of a knife blade between the panels, and an elongated, flexible magnetic strip carried at the inner face of one of said panels for engagement with a knife blade inserted into the sheath, said magnetic strip being nearly coextensive in length with said panel.

2. The sheath of claim 1 further characterized in that there is an elongated flexible magnetic strip carried at the inner face of each of said panels.

3. The sheath of claim 2 further characterized in that non-magnetic separating means are provided at said opening to separate portions of said magnetic strips adjacent said opening to facilitate insertion of the knife blade.

4. The sheath of claim 3 further characterized in that said panels and said separating means are formed from a unitary piece of leather.

5. The sheath of claim 2 further characterized by having a belt loop connected to said back panel and a stiffener plate extending from a region of said back panel to said belt loop.

6. The sheath of claim 5 further characterized in that said stiffener plate extends a substantial distance into the space between said panels between the back panel and one of said magnetic strips.

7. The sheath of claim 1 further characterized by having a belt loop connected to said back panel and a stiffener plate extending from a region on said back panel to said belt loop.

8. The sheath of claim 7 further characterized in that said stiffener plate extends a substantial distance into the space between said panels and has a longitudinal flange thereon at one edge region of said panels.

* * * * *